United States Patent [19]

Parrotta et al.

[11] Patent Number: 4,890,872

[45] Date of Patent: Jan. 2, 1990

[54] FLAT PAPER SHEET ITEM FOR DISTRIBUTING A THIN LAYER OF MATERIAL

[75] Inventors: Michael A. Parrotta, Hamilton Square; Frederick Grainger, West Greenbrook; Donald W. Schoenleber, Bellemead, all of N.J.

[73] Assignee: Webcraft Technologies, Inc., No. Brunswick, N.J.

[21] Appl. No.: 325,117

[22] Filed: Mar. 20, 1989

Related U.S. Application Data

[63] Continuation of Ser. No. 246,942, Sep. 20, 1988, abandoned, which is a continuation of Ser. No. 17,593, Feb. 24, 1987, abandoned, which is a continuation-in-part of Ser. No. 917,079, Oct. 8, 1986, abandoned.

[51] Int. Cl.[4] ..... G09F 5/00; B65D 73/00

[52] U.S. Cl. ..... 283/56; 283/903; 132/317; 206/581; 206/823

[58] Field of Search ..... 132/79 D

[56] References Cited

U.S. PATENT DOCUMENTS 4,824,143 4/1989 Grainger ..... 283/56

*Primary Examiner*—Douglas D. Watts
*Assistant Examiner*—Y. Lin
*Attorney, Agent, or Firm*—Shlesinger & Myers

[57] ABSTRACT

A relatively flat packet for distributing thin layers of material, which provide a substantial recess so as to limit the possibility of contact with surfaces that could impair the integrity of the layer of material enclosed in the packet item from smearing and abrasion.

18 Claims, 2 Drawing Sheets

FLAT PAPER SHEET ITEM FOR DISTRIBUTING A THIN LAYER OF MATERIAL

BACKGROUND OF THE INVENTION

This application is a continuation of application Ser. No. 246,942, filed 09/20/88, which is the continuation of application Ser. No. 017,593, filed 02/24/87, which is a continuation-in-part of application Ser. No. 917,079, filed Oct. 8, 1986, all now abandoned.

This invention relates to packets, and particularly to compact paper packets, containing readily removable thin layer of soft spreadable material.

Thin paper product containing packages, particularly for advertising purposes, have been recently introduced for low cost mass distribution to provide small amounts of a product for sampling purposes.

Many of the product layer material distributed, such as cosmetics, are soft and will easily smear, or adhere to other surfaces, such as paper, on coming into contact with them.

This presents a problem involving acceptability of the packet item as a finished effectively packaged item. The contact of a surface that will bring about smearing, abrasion of the product material surface, and loss of material from the layer to the contacting surface, are therefore to be avoided or minimized if possible.

Further complicating this problem is the requirement that the product must be simple and inexpensive, and the layer of material should be readily accessible to the user without an undue expenditure of effort. These pieces should present a good finished appearance, also.

This is particularly true in advertising items containing a layer of sample material. In such cases, it is desirable that the protective cover, which may be an opposing page of a brochure or a packet, also contain printing material. Such page cannot be marred by loose deposits of the sample material with which portions of it may come into contact when the packet or folder item is shipped.

SUMMARY OF INVENTION

Accordingly, it is a principal object of this invention to provide a flat paper distribution packet item in which the enclosed layer of material is protected from smearing and abrasion.

It is also a feature of this invention to provide a relatively flat packet for distributing thin layers of material, which provide a substantial recess so as to limit the possibility of contact with surfaces that could impair the integrity of the layer of material enclosed in the packet item.

The packet also provides for distribution an inexpensive product containing item which a very high percentage of printing area. Further, it permits the fabrication of a packet item structure by high speed in-line presses, so that both the printing and the fabrication of the structural elements of the packet item are included in a single pass operation.

DESCRIPTION OF THE INVENTION

Figure 1:
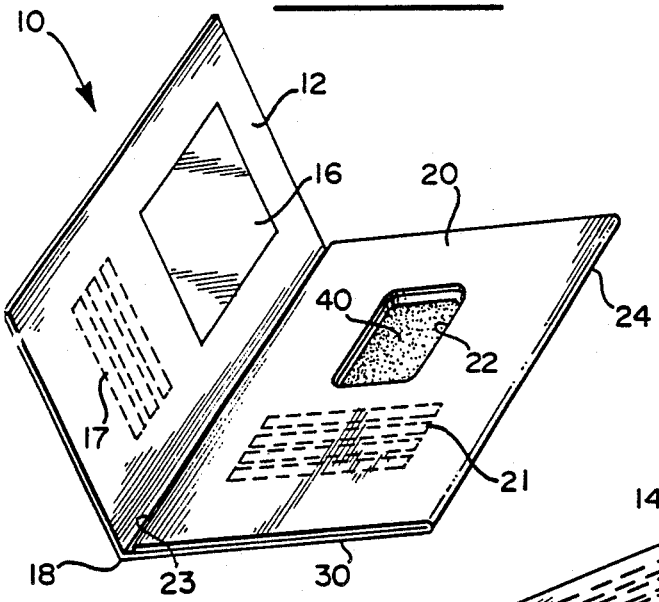
FIG. 1 is a perspective view showing a flat paper sheet item containing a thin layer of removable material.
Figure 2:
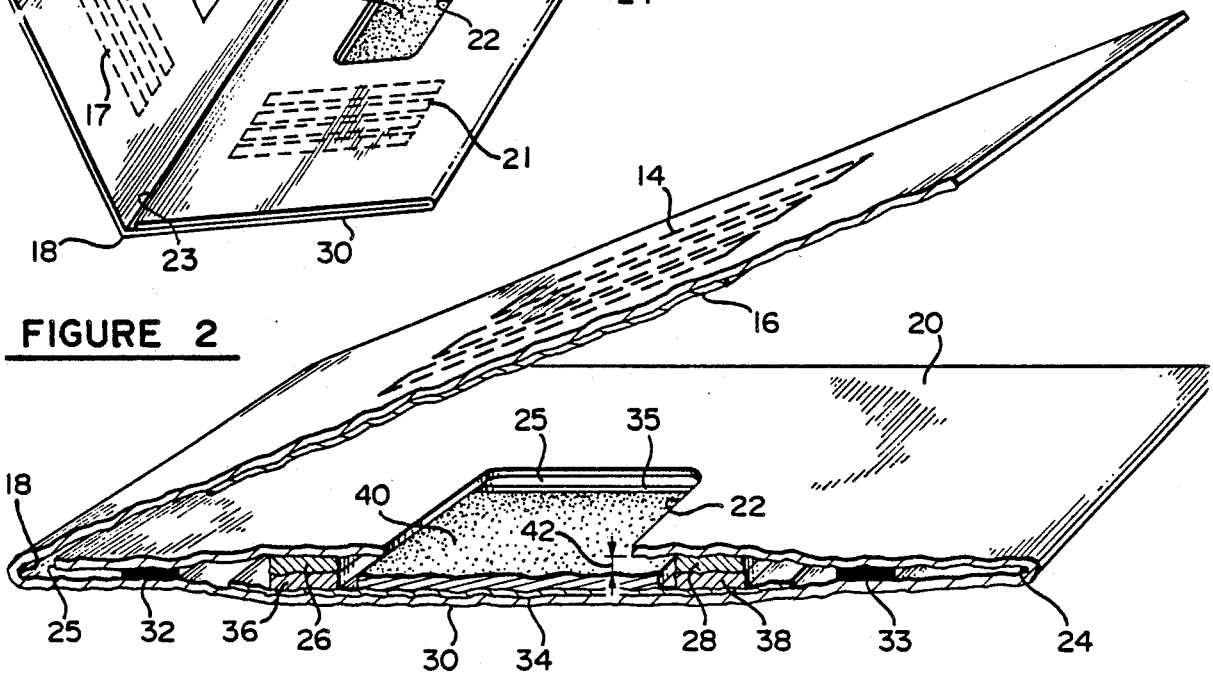
FIG. 2 is a partial perspective view showing in cross-sectional configuration the item of FIG. 1.
Figure 3:
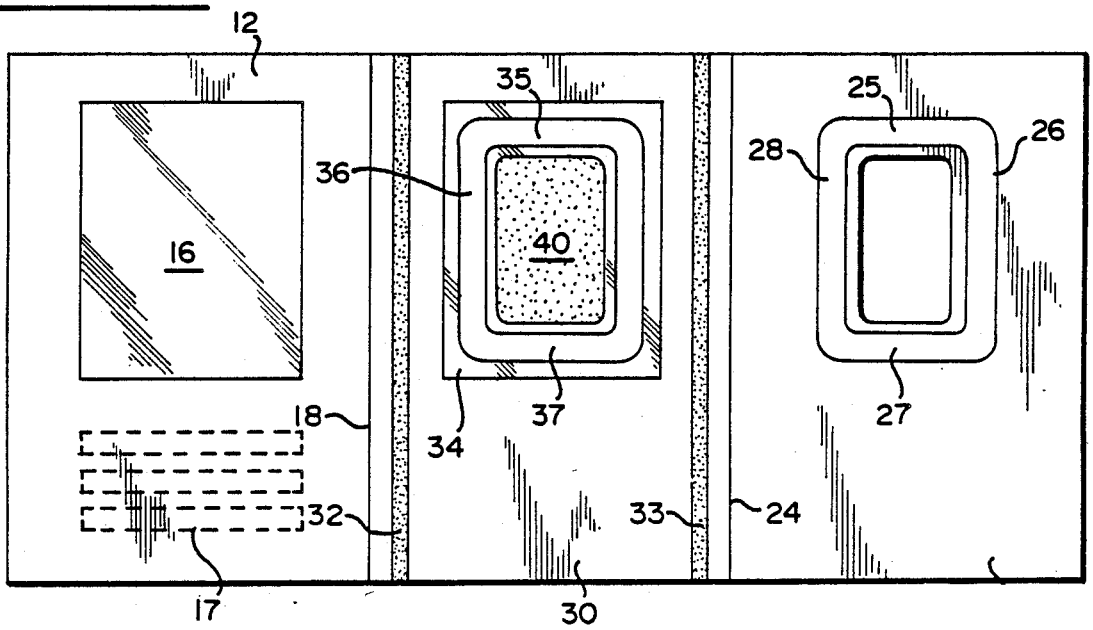
FIG. 3 is a plan view of the open unfolded flat sheet which makes up the paper sheet item of FIGS. 1 and 2, as it would appear prior to the folding of the panels.

Referring particularly to FIGS. 1 through 3, a flat paper sheet packet which contains a layer of material to be distributed. The item is generally indicated at 10. It is constructed of paper sheet material which has a rectangular cover panel 12, having an outer face containing printed material 14 and an inner face containing a barrier layer coating 16 which provides a smooth impervious non-adhesive surface. It also has printing 17 disposed below the barrier layer coating. The cover panel 12 is hingedly connected along fold line 18 through a rectangular base panel 30. The base panel 30 is connected to a rectangular spacer panel 20 along a longitudinally extending fold line 24.

The spacer panel 20 contains printing material 21 and a generally rectangular die cut opening 22. Its interior side edge 23 extends parallel to the fold line 18.

The interior surface of the spacer panel 20 as shown in FIG. 3 contains a substantially rectangular expansible foam layer having top 25, bottom 27 and lateral sides 26 and 28.

The base panel 30 is integrally connected to the separator panel 20 by longitudinally extending glue strips 32 and 33. A barrier layer 34 of rectangular configuration as seen in FIGS. 2 and 3 provides a smooth impervious surface for the generally rectangular layer 40 of the material to be enclosed with the item. This material is cosmetic material which is a caked pliable layer which has an oil or grease content.

The barrier layer provides a smooth surface which will provide a smooth uninterrupted surface to which the cosmetic similar type of material will not stick, and from which it can be readily removed by rubbing.

The barrier layer is applied as an aqueous solution in a wet liquid state to the panel 30 and is then subsequently dried. The liquid solution consists of 10% carboxy methyl cellulose, 30% anhydrous alcohol, and 60% water. The resulting barrier layer is smooth and non-porous and will preclude any "bleed-through" of oil or grease through the paper from the layer 40 to detract from any printing that would be placed on the exterior surface of panel 30.

In order to provide additional clearance or recess from the top or exposed face of spacer panel 20 and the surface of the cosmetic layer, a foam plastic composition identical to that applied to the interior face of spacer panel 20 is applied to the interior face of base panel 30.

The spacer is a substantially rectangular configured layer of rigid foam plastic and having top 35, bottom 37 and sides 36 and 38.

The pamphlets are produced by in-line printing equipment in which blanks are successively printed on a web of paper, and then a barrier layer solution is applied and dried.

The cosmetic material is also applied as a wet layer using a printing type of technique. Heat is applied to the web expands the plastic foam material which expands to a thickness of 4 to 6 thousands of an inch.

Figure 4:
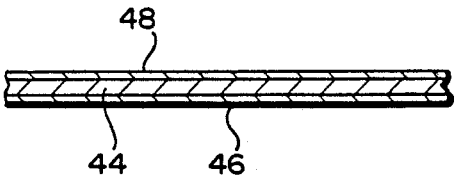
FIG. 4 is a partial cross-sectional view of the sheet material used in the production of the flat paper item of FIGS. 1 through 3.

It should be noted with respect to FIG. 4 that the preferred type of paper used for this type of item is coated two side stock which includes, as shown in cross-section in FIG. 4, the central paper sheet 44 with a coating 46 and 48, such as conventional clay or other type of coatings used to enhance printability of paper stock with a smooth surface.

Figure 5:
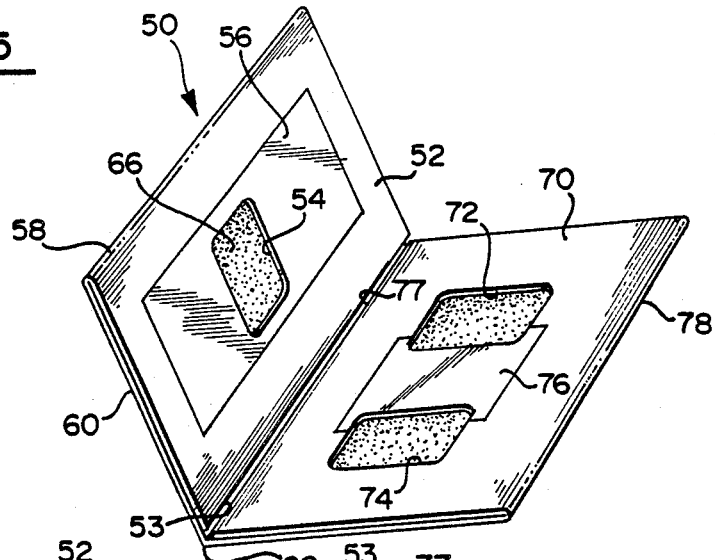
FIG. 5 is a perspective view of another modication of the flat sheet packet item.
Figure 6:
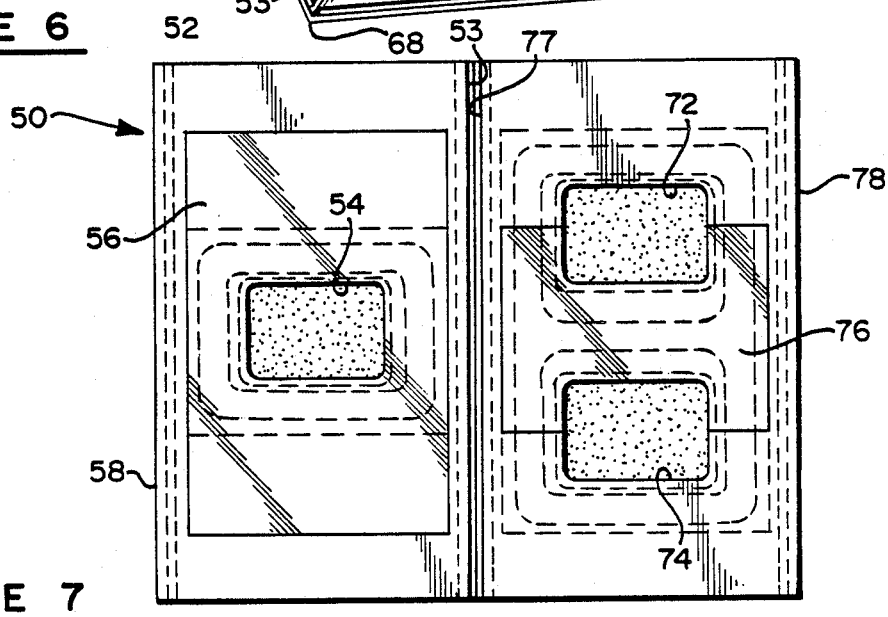
FIG. 6 is a plan view of the opened item of FIG. 5.
Figure 7:
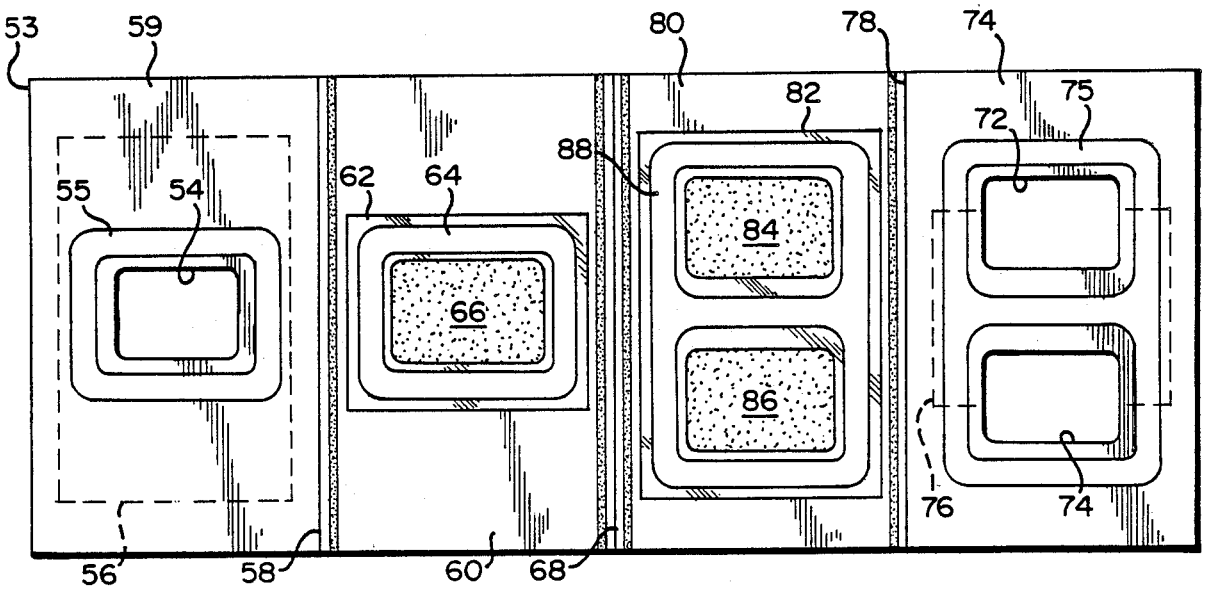
FIG. 7 is a plan view of a completed sheet for an item prior to folding.

FIG. 5 shows a booklet type of printed item with multiple product material containing dockets and access openings. Referring to FIGS. 5 through 7, the flat printed packet item generally indicated at 50 has a spacer panel 52 with a die cut generally rectangular access opening 54 and a side edge 53. A rectangular barrier layer 56 extends substantially the length of the rectangular spacer panel 52. The outer edge is a fold line 58 through which it is connected to the base panel 60 and of similar construction to the previously described base panel of FIGS. 1 and 3.

Referring to FIG. 7, the interior face 59 of cover panel 52 has a foam spacer layer 55. This corresponds to the spacer layer 64, so that both panels contribute additional depth to the pocket which is formed when separator panel 52 is folded over the base panel 60 to bring both rigid foam spacing layers 55 and 64 into superposed relation.

The barrier layer 62 provides a substrate for the cosmetic or other product layer 66 and operates to seal the paper.

The two panels are held together by the spaced longitudinally extending glue lines disposed adjacent the fold lines 58 and 68.

The other portion of the cosmetic material folder includes a spacer panel 70 having two substantially rectangular die cut access openings 72 and 74 and an intermediate rectangular barrier coating layer 76 on its upper and external face. Both sides of the panel are shown at edge 77 and fold line 78. Referring to FIG. 7, the interior surface of the spacer panel 70 has a rectangular outlined plastic foam layer 75 with internal generally rectangular openings slightly spaced from the periphery of the access openings 72 and 74.

The spacer panel 70 is connected along fold line 78 to the base panel 80, which has a solid rectangular barrier layer 82 on which cosmetic sample product layers 84 and 86 are disposed. The rigid foam layer 88 corresponds in shape to the foam layer 75 disposed on interior surface 79 of spacer panel 70.

When the cover panels are folded over on their respective base panels, the foam layers when superimposed upon each other provide a depth of 8 to 12 thousands, which subsequently provides that additional amount of clearance to further preclude any contact with an opposing sheet of material.

The foam material is a foamed and expanded polymer coating which is commercially available and sold under the trade name FOAM COAT. It is applied in a liquid state and dried at approximately 140° F., and subsequently expanded at 220° F. It is a mixture of hollow synthetic micropheres of thermoplastic synthetic resinous material which contain a volatile liquid foaming agent. It is applied as a water base coating. U.S. Pat. Nos. 3,615,972, 3,515,569, 3,819,463, 3,864,181 and 4,006,273 are of interest with respect to this product, which will expand in place to produce a low density white coating.

With respect to the use of the construction of the packet item, it should be noted that a relatively deep pocket is formed when the foam plastic coating expands. With this expansion, the clearance between the top surface of the cosmetic material, such as lipstick, is increased, thereby reducing the possibility of contact of this surface with an opposing surface. Also, if there does happen to be some contact, at least minimizing pressure between the two surfaces so that there is no pendency for the cosmetic layer to be disturbed.

To further retard smearing, a barrier layer is used. The smooth surface of the barrier layer will reduce the possibility of abrasion of the cosmetic surface, or its possible appearance to the opposing covering sheet.

With some types of material layers, such as a lipstick, it may be preferable to use both a two side coated stock, as well as a barrier layer to provide a particularly thick impermeable substrate.

While this invention has been described as having preferred design, it is understood that it is capable of further modification, uses and/or adaptations of the invention following in general the principle of the invention and including such departures from the present disclosure as come within known or customary practice in the art to which the invention pertains, and as may be applied to the essential features set forth, and fall within the scope of the invention of the limits of the appended claims.

What is claimed is:

1. A flat paper-sheet item containing a thin removable layer of a given material, comprising:

(a) a paper base panel with an upper face having at least one material-containing section with a smooth and impervious surface, (b) a relatively thin uniform cohesive layer of spreadable material which is disposed on the material-containing section from which it is readily removable upon application of light sliding contact by another surface, (c) a paper spacer piece which is integrally connected to the base panel and extends adjacent and along at least a portion of the periphery of each material-containing section to limit contact of other surfaces with the surface of the layer of spreadable material, (d) a solid plastic foam spacer layer disposed between the base panel and the spacer piece immediately adjacent to the material-containing section for providing additional spacing between the engaging surface of the spacer piece and the upper surface of the base panel.

2. The flat paper-sheet item as set forth in claim 1, wherein:

(a) the solid foam spacing layer forms a continuous side wall about the spreadable material.

3. The flat paper-sheet item as set forth in claim 1, wherein:

(a) the solid foam spacing layer is a heat activated foamable polymer coating.

4. The flat paper-sheet item as set forth in claim 3, wherein:

(a) the solid foam spacing layer is a residual coating obtained from a thermoplastic synthetic resinous material and a volatile liquid foaming agent.

5. The flat paper-sheet item as set forth in claim 1, wherein:

(a) each material-containing section of the base panel has a barrier layer coating which provides it with a smooth and impervious surface.

6. The flat paper-sheet item as set forth in claim 5, wherein:

(a) the barrier layer is a coating which is a residue of a volatile aqueous solution of carboxy-methyl cellulose.

7. The flat paper-sheet item as set forth in claim 1, wherein:

(a) the base panel is rectangular and the paper spacer piece is a rectangular panel co-extensive therewith which has an access opening aligned with each material-containing section.

8. The flat paper-sheet item as set forth in claim 7, wherein:

(a) a spacer panel is connected to the base panel along a common fold line which is disposed along a respective side of each panel.

9. The flat paper-sheet item as set forth in claim 1, wherein:

(a) a movable cover panel having a smooth and impervious surfaced barrier layer at least as large as and aligned with the layer of spreadable material which overlies the base panel and is hingedly connected thereto.

10. The flat paper-sheet item as set forth in claim 9, wherein:

(a) the base and cover panels being rectangular and superposed with respect to each other and connected beyond the spacer piece and along corresponding side edges to provide a movable covering for the spreadable material surface.

11. The flat paper-sheet item as set forth in claim 10, wherein:

(a) the spreadable material is a cosmetic, and (b) the barrier layer and the foam spacer layer form a shallow container-like recess for the Cosmetic material.

12. The flat paper-sheet item as set forth in claim 11, wherein:

(a) the Cosmetic material is a flat layer of lipstick, the upper surface of which is disposed below the upper face of the paper spacer piece.

13. The flat paper-sheet item as set forth in claim 12, wherein:

(a) the base panel contains two longitudinally spaced substantially rectangular material-containing sections, (b) the paper spacer piece is a panel co-extensive with the base panel and has two longitudinally spaced access openings aligned with each material-containing section, and (c) the foam spacer layer forms a continuous side wall about each material-containing section.

14. The flat paper-sheet item as set forth in claim 11, wherein:

(a) the paper spacer piece is a rectangular panel substantially co-extensive with the base panel and has an access opening aligned with each material-containing section on the base panel, and (b) the spacer panel is connected to the base panel along a common fold line disposed along a respective side edge of each panel.

15. The flat paper-sheet item as set forth in claim 14, wherein:

(a) the printed material is contained on the exterior surfaces of the spacer and base panels, and on the surfaces of the cover panel.

16. The flat paper-sheet item as set forth in claim 15, wherein:

(a) the cosmetic material is a flat layer of lipstick, the upper surface of which is disposed substantially below the upper face of the paper spacer panel.

17. The flat paper-sheet item as set forth in claim 16, wherein:

(a) a second paper base panel having an upper face with at least one material-containing section with a smooth and impervious surface and is connected to the first base panel along a common fold line disposed along an edge of the base panel, (b) the second base panel containing a relatively uniform cohesive layer of spreadable material which is disposed on the material-containing section from which it is readily removable upon application of light sliding contact by another surface, (c) a second paper sheet spacer panel connected to the second base panel and having an access opening aligned with the material-containing section of the second base panel, (d) a solid plastic foam spacing layer disposed between the second base panel and the second spacer panel immediately adjacent to the material containing section and the periphery of the access opening in the second spacer panel for providing additional spacing between the engaging surface of the second spacer panel and the upper face of the second base panel, (e) the access openings in the spacer panels coming into contact with each other to act as a cover piece when the base panels are folded into superposed relation, and (f) the access openings in the spacer panels being staggered with respect to each other and the spacer panel surface having a smooth impervious coating which covers and extends over the access opening of the opposed spacer panel so as to provide a non-adhering surface which faces the spreadable material surface within the access opening of the opposer spacer element.

18. The flat paper-sheet item as set forth in claim 17, wherein:

(a) one of the spacer panels has two substantially rectangular laterally spaced access openings surrounding different cosmetic layer material, and the opposed spacer panel has one access opening which is longitudinally positioned opposite the space between the access opening of the opposed spacer panel, (b) the periphery of the access opening also enclosing a substantially rectangular layer of cosmetic material, and (c) the exterior surfaces of the base panels, and the exterior surface of the spacer panels containing printed material.

* * * * *